US009120131B2

(12) United States Patent
Sundholm

(10) Patent No.: US 9,120,131 B2
(45) Date of Patent: Sep. 1, 2015

(54) METHOD AND APPARATUS FOR SORTING WASTES

(75) Inventor: Göran Sundholm, Tuusula (FI)

(73) Assignee: MARICAP OY, Vantaa (FI)

( * ) Notice: Subject to any disclaimer, the term of this patent is extended or adjusted under 35 U.S.C. 154(b) by 0 days.

(21) Appl. No.: 13/395,661

(22) PCT Filed: Aug. 25, 2010

(86) PCT No.: PCT/FI2010/050670

§ 371 (c)(1),
(2), (4) Date: Mar. 13, 2012

(87) PCT Pub. No.: WO2011/029991

PCT Pub. Date: Mar. 17, 2011

(65) Prior Publication Data

US 2012/0168354 A1 Jul. 5, 2012

(30) Foreign Application Priority Data

Sep. 14, 2009 (FI) ..... 20095945

(51) Int. Cl.
*B07C 5/344* (2006.01)
*B07C 5/34* (2006.01)
(Continued)

(52) U.S. Cl.
CPC ..... *B07C 5/3412* (2013.01); *B03B 9/00* (2013.01); *B07C 3/06* (2013.01); *B07C 3/16* (2013.01)

(58) Field of Classification Search
CPC ..... B03B 9/00; B07C 5/3412; B07C 3/06; B07C 3/16; B07C 3/18; B07C 3/085
USPC ..... 209/930, 546, 552, 583, 576
See application file for complete search history.

(56) References Cited

U.S. PATENT DOCUMENTS 3,520,406 A * 7/1970 Turner ..... 209/576
5,100,005 A 3/1992 Noble et al.
(Continued)

FOREIGN PATENT DOCUMENTS

CN 101326016 A 12/2008
CN 2013-46539 Y 11/2009
(Continued)

OTHER PUBLICATIONS

"Avfallsplan for Sodertalje Kommun" Version Mar. 9, 2003 (pp. 1-22 and 23 page English translation).
(Continued)

*Primary Examiner* — Ernesto Suarez
(74) *Attorney, Agent, or Firm* — Birch, Stewart, Kolasch & Birch, LLP

(57) ABSTRACT

A method for sorting wastes wherein waste or recyclable material is supplied in carrier bags. A sorting apparatus includes a conveyor provided for receiving the carrier bags for separation from each other by guiding the carrier bags into containers according to an allotment. An RFID identifier is connected to each carrier bag. A closing member is provided with the RFID identifier in closing, or as verification of closing. At least one sensor is utilized on the basis of the information read from the RFID identifier of the closing member. At least one handling device, such as a robot, is provided wherein the at least one handling device is controlled to transfer the carrier bags to be sorted from the conveyor into the different allotments on the basis of the information given by the RFID identifiers. The invention also relates to an apparatus.

24 Claims, 4 Drawing Sheets

(51) Int. Cl.

| | |
|---|---|
| ***B03B 9/00*** | (2006.01) |
| ***B07C 3/06*** | (2006.01) |
| ***B07C 3/16*** | (2006.01) |

(56) References Cited

U.S. PATENT DOCUMENTS

| | | | | |
|---|---|---|---|---|
| 5,299,693 | A | 4/1994 | Ubaldi et al. | |
| 5,425,456 | A * | 6/1995 | Erickson | 209/2 |
| 5,588,534 | A * | 12/1996 | Harel | 209/3.1 |
| 5,590,791 | A * | 1/1997 | Gschweitl | 209/577 |
| 5,628,412 | A * | 5/1997 | Hulls | 209/702 |
| 6,478,229 | B1 * | 11/2002 | Epstein | 235/492 |
| 6,811,030 | B1 * | 11/2004 | Compton et al. | 209/2 |
| 7,328,842 | B2 * | 2/2008 | Wagner et al. | 235/385 |
| 7,416,084 | B2 | 8/2008 | Tse | |
| 2004/0133484 | A1 | 7/2004 | Kreiner et al. | |
| 2007/0208455 | A1 | 9/2007 | Bollengraaf et al. | |

FOREIGN PATENT DOCUMENTS

| | | | |
|---|---|---|---|
| EP | 0 439 674 | B1 | 4/1994 |
| EP | 6-329235 | A | 11/1994 |
| EP | 1854556 | A1 | 11/2007 |
| EP | 1 829 621 | B1 | 5/2011 |
| GB | 2449710 | A | 12/2008 |
| JP | 0561101 | U | 8/1993 |
| JP | 3006196 | U | 1/1995 |
| JP | 2002179201 | A | 6/2002 |
| JP | 2007-167824 | A | 7/2007 |
| JP | 2009-140186 | A | 6/2009 |
| WO | WO 91/01818 | A | 2/1991 |
| WO | WO 03/039773 | A1 | 5/2003 |
| WO | WO 2006/096101 | A1 | 9/2006 |

OTHER PUBLICATIONS

Debag Systems, "Getting it out of the Bag," Mar. 1992, (pp. 49-54).

God Bebuggd Miljo, Ett omfattande malomrade, pp. 26-33 (partial English translation attached of p. 30).

Leghorn SRL, tuloste web-arkistosta, Paivays, Sep. 13, 2008 (1 page).

www.scarabmfg.com, printout from Internet, marked copyright 2009, "Bag Opener" Scarab Model 15 (1 page).

* cited by examiner

METHOD AND APPARATUS FOR SORTING WASTES

BACKGROUND OF THE INVENTION

The invention relates generally to waste handling and more particularly to the sorting of wastes.

Nowadays it is typical, e.g. in respect of household waste, that households use different bags, sacks or carrier bags as waste bags, in which waste is placed. For example, in Finland it is normal to use plastic carrier bags from shops, in which shopping has been carried home, as waste bags. Wastes are carried in plastic carrier bags to a waste bin, into which typically the bag with its contents, closed with a knot is placed. The wastes are transported onwards for further processing by a garbage truck. In the current systems one disadvantage, among others, is that the sorting of wastes is awkward. It is often possible that users do not bother to sort wastes into different allotments, but instead mix all wastes in the same waste bag or waste bin. In this case mixed waste is produced, the reclamation of which is difficult.

Known in the art are solutions for sorting waste, in which solutions different types of wastes are arranged to be transported in different containers, such as in waste bags or bins of different colors. For example, households place different types of wastes in waste bags of different colors. A waste bag of a specific color is specified for each type of waste. Wastes are transported e.g. in a normal garbage truck to a waste center, where the wastes are sorted into different allotments on the basis of the colors of the waste bags. The sorting of waste optically is described in publication EP0759816. A drawback in this method is that there must be waste bags separately arranged for the purpose for each waste type to be sorted. Another drawback is also the uncertainty of operation of the automatic optical sorting apparatus used in sorting the waste bags in a dirty environment. The sorting of waste is described in publication WO03039773 A1.

On the one hand, nothing guarantees that a waste producer, such as a household, will use a waste bag of the correct color for each type of waste. It is difficult to get misusers of the system to change their habits. On the other hand, identifying or tracing a misuser after the event is almost impossible.

Furthermore, it is typical when using plastic carrier bags or plastic bags as waste bags that the knot made in the bag, e.g. from the carrying handles, opens, in which case the wastes can spread freely during transportation to outside the bag. This makes the transport vehicle, the waste bin and/or other waste bags dirty on the outside, hampering the sorting process and also forming a hygiene problem. The waste bags with the waste they contain, end up nowadays, at a landfill site, which is a considerable problem.

For example, 10-20% of waste bags can be partly or wholly broken, in which case miscellaneous detached waste moves on the conveyor belt of a conveyor in the sorting of waste in addition to waste bags. In this case, when using handling devices that are of the type that push the waste allotment in question from the conveyor of the waste bags directly to the side, it causes other detached waste that is on the conveyor belt to also go along with the waste bags. This is undesirable for achieving satisfactory sorting.

The aim of the invention is to achieve a new type of solution in the sorting of wastes, by means of which the problems of prior art can be avoided.

BRIEF DESCRIPTION OF THE INVENTION

The invention is based on a concept wherein wastes, more particularly waste bags, are provided with an RFID identifier and the wastes are taken to a sorting center or corresponding, in which a sorting apparatus is provided with a sensor that reads the information of the RFID identifier of the waste, more particularly of the waste bag. The information read by the sensor is transmitted to the sorting apparatus, which sorts the different waste allotments on the basis of the RFID identifier.

The solution according to the invention has a number of significant advantages. By using a closing means according to the invention, it is, on the other hand, ensured that waste bags, waste carrier bags, waste sacks or corresponding stay closed in transportation, and also the operation of the system, such as more effective sorting than earlier, can be controlled by means of an RFID identifier. Arranging an RFID identifier in a closing means enables the use of any bag, carrier bag, sack, or corresponding whatsoever in waste transport and does not require special separate transport containers intended for certain waste allotments. In this case only one disposal point can be conveniently used for different materials in connection with the waste transport system, in which case wastes are sorted in the system later, e.g. in a waste center, a sorting center or corresponding, into different allotments according to an RFID identifier. At the same time, feeding of waste material without an RFID identifier according to the invention, into a disposal point of the system can also, if necessary, be prevented, e.g. by arranging the door of the waste room to open only by means of an RFID identifier.

In the waste sorting center, to which the waste bags are transported conventionally with garbage trucks or in some other way, such as with a pneumatic waste transfer system, the waste bags are sorted into different waste allotments on the basis of the information given by the RFID identifiers. After this the waste bags are ripped open and the bags are removed from the rest of the waste. In this case it is possible to avoid bags ending up at a landfill site. The material of the bags can be recycled and reused. The RFID identifier of the closing means according to the invention can still be used to verify by the aid of a reader means that the waste bags have been removed from the sorted waste allotments.

A dedicated closing means comprising an RFID identifier is arranged for each waste allotment. Recyclable paper, for instance, is handled in a corresponding manner. In this case paper, such as newspapers, is placed in a bag and it is closed with a closing means according to the invention, which closing means comprises an RFID identifier.

An RFID identifier can be used to register the amount of waste produced by a certain user, in which case invoicing principles can be changed. On the other hand, a waste producer can be rewarded for sorting waste, e.g. by reducing the waste transport fees of waste that is fit for recycling.

According to a typical embodiment, the closing means is a sticker tape, which is an RFID sticker tape of the color of the waste allotment, which sticker tape comprises e.g. a text identifier according to the type of waste. In addition, an identification number or other identifier, which is separately specified according to each household, housing company, company or other waste producer that produces waste, can be formed for a closing means and/or RFID identifier. A closing means can also comprise a picture or drawing of the waste type in connection, with which the closing means in question is intended to be used.

The invention can thus be utilized by using the ordinary plastic carrier bags of a shop, which bags are closed with a closing means according to the invention. The carrier bag is filled with waste and closed by knotting its carrying loops. A typical way is to tie at first one knot, after which a closing means, preferably a sticker tape, is placed on top of the knot, and fixed over the knot of the carrier bag. After that a second knot is made with the carrying loops. The RFID identifier in this case remains at least partly protected and avoids transport damage. The closing means according to the invention also prevents the opening of the knots of the waste bag.

Using a closing means according to the invention in pneumatic pipe transport has the advantage that a dedicated disposal point for different allotments is not needed, but instead all waste goes to the same disposal point. In normal waste transport waste containers of only a single type are needed, and only one garbage truck collects them instead of 3-4 trucks. It is also advantageous if all wastes, such as mixed waste, biowaste, glass waste, metal waste and paper waste, are placed into a bag. In this case the allotments stay clean and their transportation is easier. The bag is automatically removed in a sorting center.

The invention can be applied according to one preferred embodiment so that dedicated closing means, which comprise RFID identifiers, are supplied to each household or other waste-producing community or corresponding. This assists sorting. In addition, by means of the combination of a closing means and RFID identifier according to the invention, it is easy to demonstrate where the costs of the waste handling system are generated. Fees can thus be allocated to waste producers more accurately than earlier.

According to one preferred embodiment, households have a fixed waste charge and receive a credit for each waste bag sorted in a sorting center. Based on the automatic reading of RFID identifiers, the system can allocate the sorted wastes by means of an information system so that the credit goes to the correct target.

Sorting in a sorting center on the basis of an RFID identifier is very easy, as also is identification of a household. Arranging an RFID identifier in a closing means thus gives numerous opportunities in waste sorting.

BRIEF DESCRIPTION OF THE FIGURES

In the following, the invention will be described in detail by the aid of some embodiments with reference to the attached drawings, wherein.

DETAILED DESCRIPTION OF THE INVENTION

Figure 1:
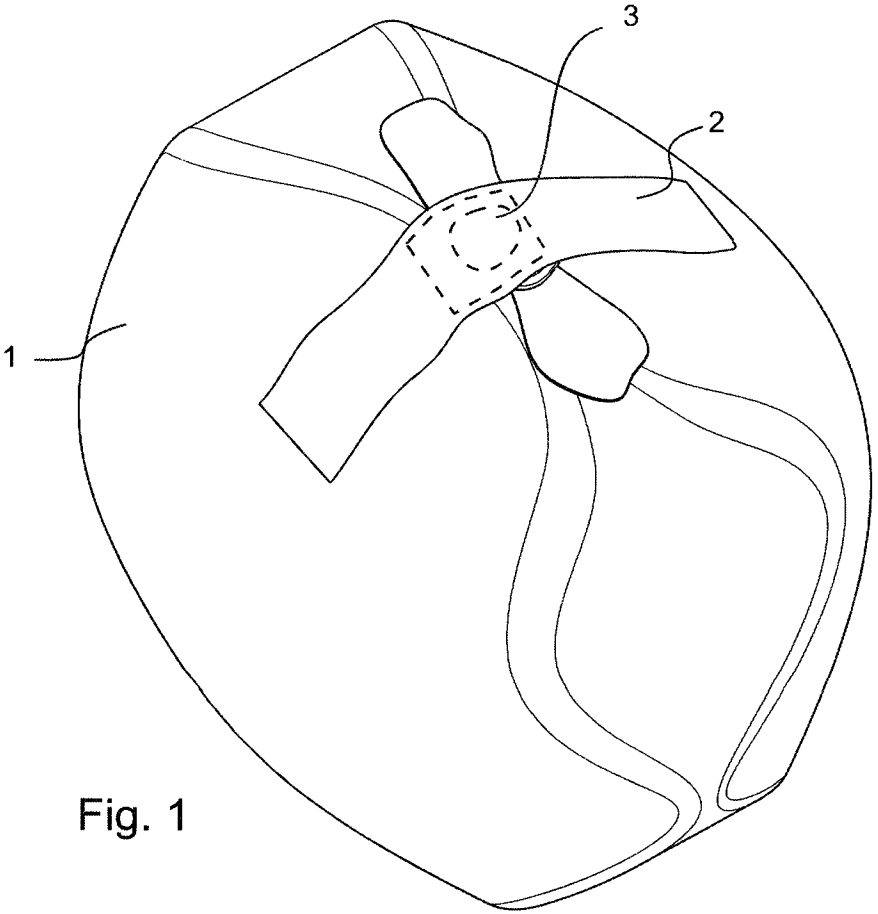
FIG. 1 presents one embodiment of a closing means applicable in a system according to the invention, in connection with a waste bag.

FIG. 1 presents one embodiment of a closing means 2 provided with an RFID identifier 3 applicable in a system according to the invention, in connection with a waste bag 1. A waste producer, such as a household, company or other community, pre-sorts the wastes that it produces into waste bags 1 and provides each bag 1 containing a sortable waste type with a closing means 2 comprising an RFID identifier 3 according to the type of waste. The waste types can be e.g. mixed waste, biowaste, paper, glass, metal, cardboard, hazardous waste, etc. There is typically a dedicated closing means for each type of sortable waste, i.e. waste allotment, in which closing means the type of waste the closing means in question is intended for, can be visually seen or otherwise sensed. In addition, the closing means comprises a customer code or corresponding, which is individual to each waste-producer community, such as to a household, company or other community. The corresponding information is coded into the memory of the RFID identifier.

FIG. 1 presents a waste bag 1, to which a closing means 2 is fixed, which closing means is provided with an RFID identifier 3. The closing means 2 is arranged in the embodiment of the figure over a knot formed in the waste bag 1, in which case it prevents opening of the knot during transportation. The knot is formed e.g. by knotting the carrying loops of the bag 1. The closing means 2 comprises an adhesive surface on the side against the outer surface of the bag 1, in which case it sticks to the outer surface of the bag.

The closing means in the case of FIG. 1 comprises a base part, onto which the RFID identifier 3 is arranged in a manner that is, in itself, known in the art. The base is preferably of sticker laminate or corresponding, which can be fixed to the waste bag easily owing to the adhesive surface. The RFID identifier 3 comprises a memory part (chip) and an antenna part. The RFID identifier is preferably a passive RFID identifier, in which case it does not need its own power source.

Alternatively, the closing means 2 can be used as a closer of the conventional mouth part of a waste sack, by winding it tightly around the mouth part. If so desired, the mouth part can still be knotted or provided with an additional closer.

A waste producer, such as a household, takes a waste bag 1 provided with a closing means according to the waste type to a disposal point of the system, such as to a waste bin situated in a waste room.

The combination of a closing means 2 of a waste bag and an RFID identifier 3 can be utilized in connection with a waste transport system e.g. as follows. Closing means according to the invention, i.e. combinations of a closing means and an RFID identifier, are distributed or otherwise delivered to households or other waste producers. The RFID identifier comprises the code or corresponding identifier of each waste producer, with which code the waste producer can, if necessary, be identified. According to one preferred embodiment, the closing means 2 comprises an identification code, such as a color code, according to which the closing means is used in the system in the manner agreed in connection with each sorted waste bag. The color code can be the size of the whole closing means or a pattern or text. It is conceivable that a color code of a certain color is defined for mixed waste, a second color code for biowaste, correspondingly own color codes for recyclable materials. In this case users equip a waste bag comprising a certain type of waste with a closing means that comprises a corresponding color code.

In this way the waste bag wanted by the user can be used in connection with any different waste allotment whatsoever, and a waste producer marks a waste bag 1 only with a color code of a closing means 2 and of an RFID identifier 3 according to one preferred embodiment of the invention. Typically also an RFID identifier also already contains the waste type, in connection with which it is used.

The waste bags 1 can be transported in the desired manner, e.g. on a waste transport vehicle or on a pneumatic conveying system, to the reception center for wastes, where the wastes are sorted into different waste allotments with the sorting apparatus according to the invention. In addition, the waste bags 1 used for transportation of wastes can be separated into their own waste allotment.

Figure 2:
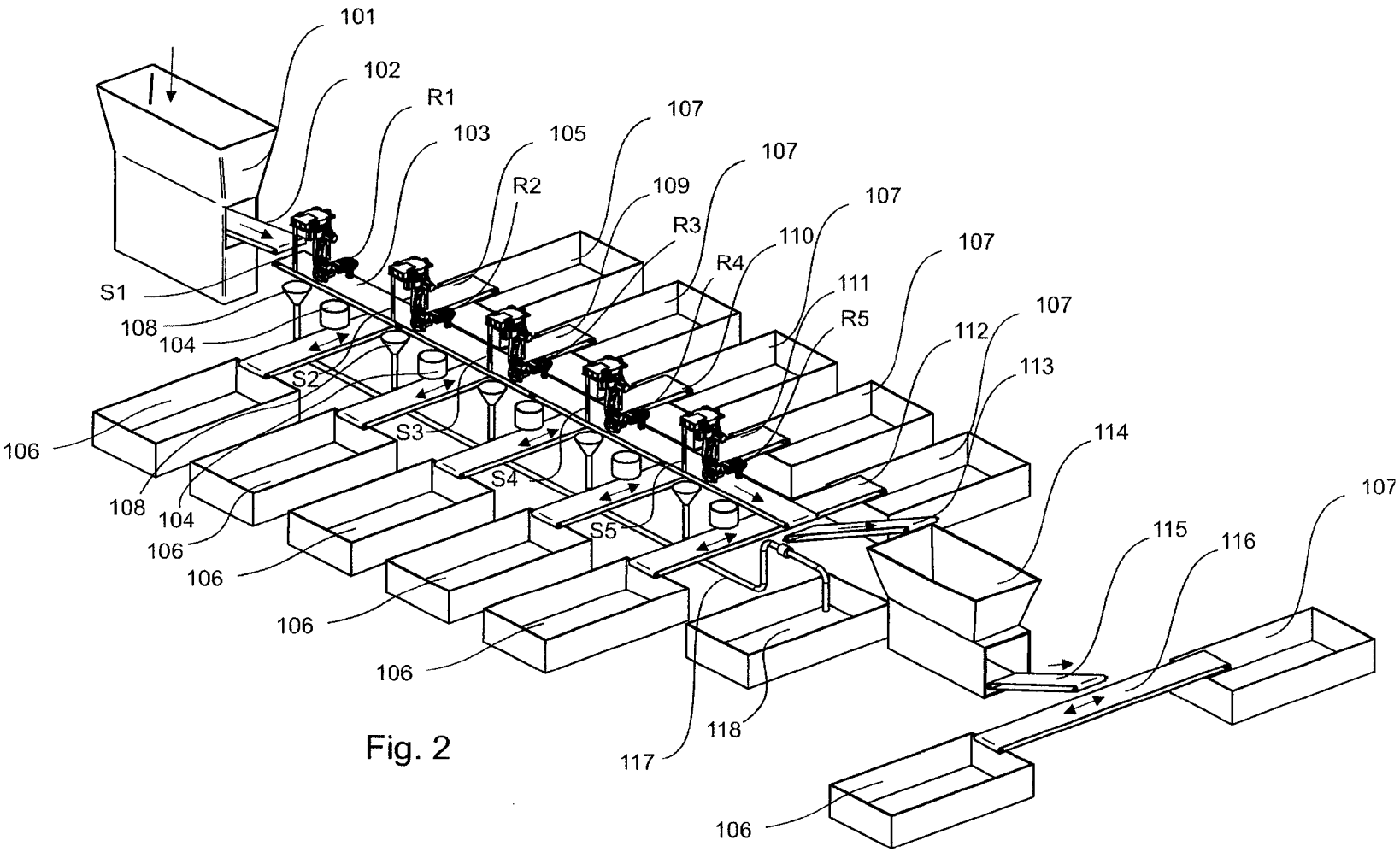
FIG. 2 presents one system according to the invention as a simplified diagram.

FIG. 2 presents a simplified and diagrammatic view of a sorting apparatus of wastes according to one embodiment of the invention. The waste bags 1 are fed into the sorting apparatus from the feed-in container 101 of the feeding apparatus onto the main conveyor 103 with the dispensing conveyor 102. Sorting conveyors 105, 109, 110, 111, 112 are arranged alongside and transversely to the main conveyor 103. Sensors S1, S2, S3, S4, S5, i.e. RFID identifier readers, which are able to read at least a part of an RFID identifier, are arranged alongside the route of the main conveyor. On the basis of the information read by the sensor S1, S2, S3, S4, S5, the handling devices R1, R2, R3, R4, R5 can be controlled. Handling devices R1, R2, R3, R4, R5 are thus arranged alongside the route of the main conveyor 103, which handling devices are able to grip a waste bag 1 and to lift the waste bag 1 from the conveyor 103 and to transfer the waste bag 1 that contains waste at first to a ripper 104, which comprises means for breaking the bag part of the waste bag such that the wastes inside the waste bag are able to move from the hole formed in the bag to the sorting conveyor 105, 109, 110, 111, 112 intended for the waste allotment in question. A sorting conveyor 105, 109, 110, 111, 112 transfers the wastes into the container 106, 107 intended for the waste allotment in question. The handling device R1 . . . R5 transfers the empty waste bag 1 into the container intended for those empty waste bags or to e.g. a feeder hopper 108 of the pipe conveyor, in which case the empty bags are moved along the transfer pipe 117 into the container 118. The pipe conveyor can be e.g. a pneumatic pipe conveyor that is, in itself, prior art, in which conveyor material is moved by means of suction and/or a pressure difference.

The sorting conveyor 105, 109, 110, 111, 112 is of the type that can be used in both directions, in which case the opposite ends of the conveyor comprise a container 106, 107 for the sorted waste allotment. In this case when the first container 106 fills, the transfer direction of the conveyor can be changed, in which case the sorting conveyor transfers the material placed onto the conveyor into a second container 107 at the opposite end. The embodiment of FIG. 2 comprises corresponding containers 106, 107 arranged in connection with each sorting conveyor 105, 109, 110, 111, 112.

The conveyors and handling devices are presented without support structures in order to increase the clarity of the figures. The handling devices R1, R2, R3, R4, R5 in the embodiments of the figures are industrial robots. Gripping means 120 are arranged on the arm of the handling devices. In addition, the arm can comprise a detector apparatus, such as a camera, by means of which the position of a waste bag on the conveyor can be detected. After this the robot is able to turn the gripper such that the picking movement is performed according to the actual location of the waste bag.

In the figure each of the sensors S1, S2, S3, S4, S5 in the embodiments of the figures are arranged in step-like fashion, through the portal of which the waste bags 1 that travel on the main conveyor 103 and that are intended for sorting, pass.

Sorting occurs with the handling devices R1, R2, R3, R4, R5 arranged in connection with the main conveyor, which devices are controlled on the basis of the signals coming from the sensors. On the basis of the information of the RFID identifier read by the sensors, a command is transmitted for transferring the waste of the waste bags to the sorting conveyors 105, 109, 110, 111, 112 intended for the different waste allotments for transporting onwards into the containers intended for the different waste allotments.

Since it is assumed that e.g. 10-20% of the waste bags are partly or wholly broken, assorted detached waste therefore moves on the conveyor belt, in addition to the waste bags. In this case, when using handling devices that are of the type that only push the waste bag of the waste allotment in question to the side, it causes at the same time also other detached waste that is on the conveyor to belt to go along. This is undesirable for achieving satisfactory sorting.

The solution according to an embodiment of the invention is that a handling device is used, e.g. a robot, which lifts the waste bag in the gripper of the handling device on the basis of a signal given to the control system by the sensor, i.e. by the RFID reader, first upwards and then the waste of the waste bag is transferred to the sorting conveyor.

Figure 3:
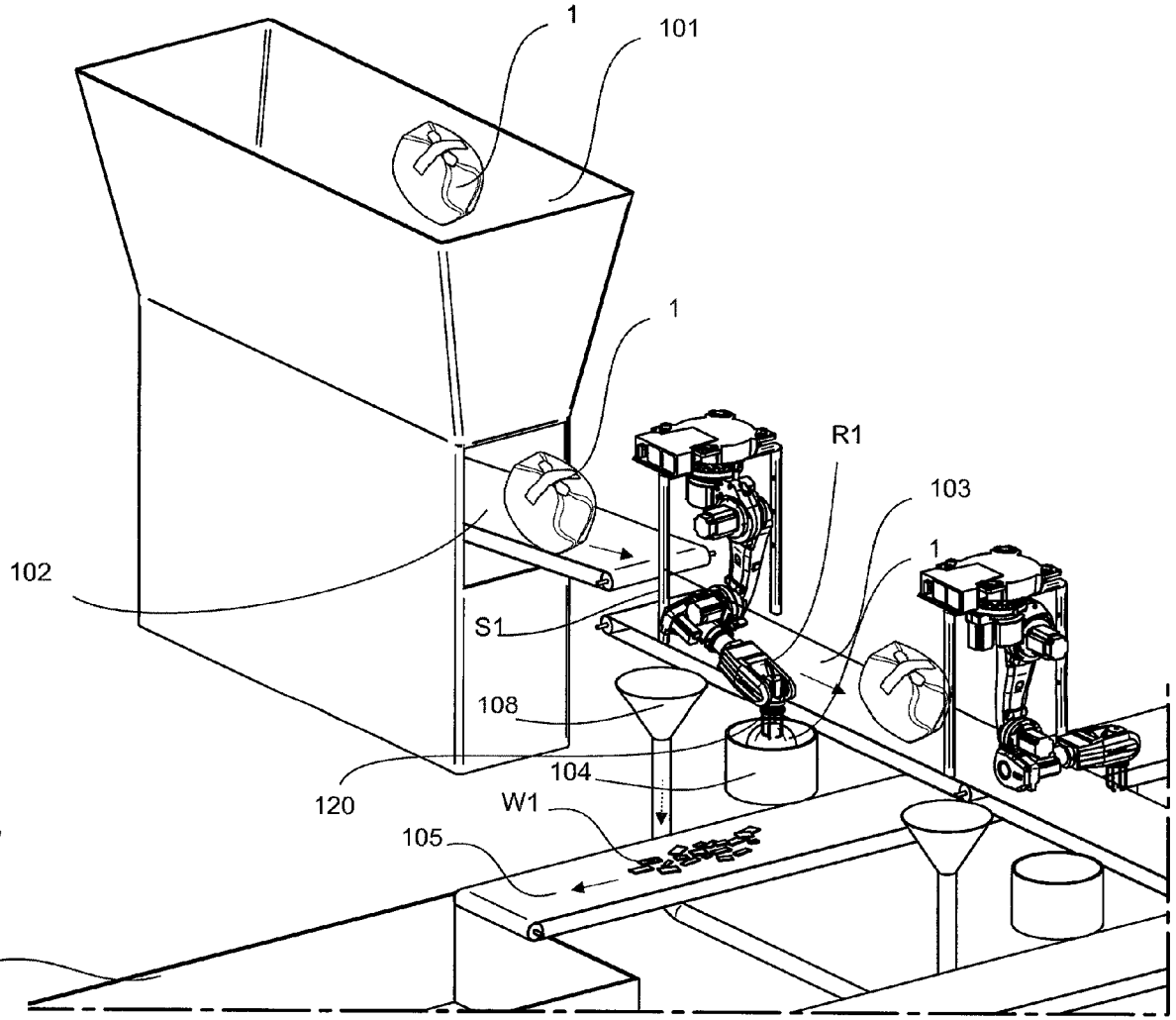
FIG. 3 presents a detail of a system according to the invention.

The grip of the gripper of the handling device, such as of a robot, can be adjusted such that the gripper grips the waste bag only at its top edge. When the waste bag is in the grip of the gripper of the robot, the bag can be moved by the robot easily in a manner that is, in itself, prior art. With the first handling means R1 the waste bag in the embodiment of FIG. 3 is transferred to the ripper 104, where a hole is formed in the bottom part of the bag, in which case the contents of the bag drop onto the sorting conveyor 105 in the embodiment of FIG. 3 The handling device R1 transfers an empty bag 1 into the container 118 intended for those e.g. to a feeder hopper 108 of the pipe conveyor 117. Alternatively the empty bag can be put back onto the conveyor belt of the main conveyor, in which case it travels into the container 114 of mixed waste arranged at the downstream end of the main conveyor. If necessary, intermediate conveyors 113 can be used. In the embodiment of FIG. 2, mixed waste can still be led from the container 114 into the transport containers 106, 107 with the conveyors 115, 116.

Figure 4:
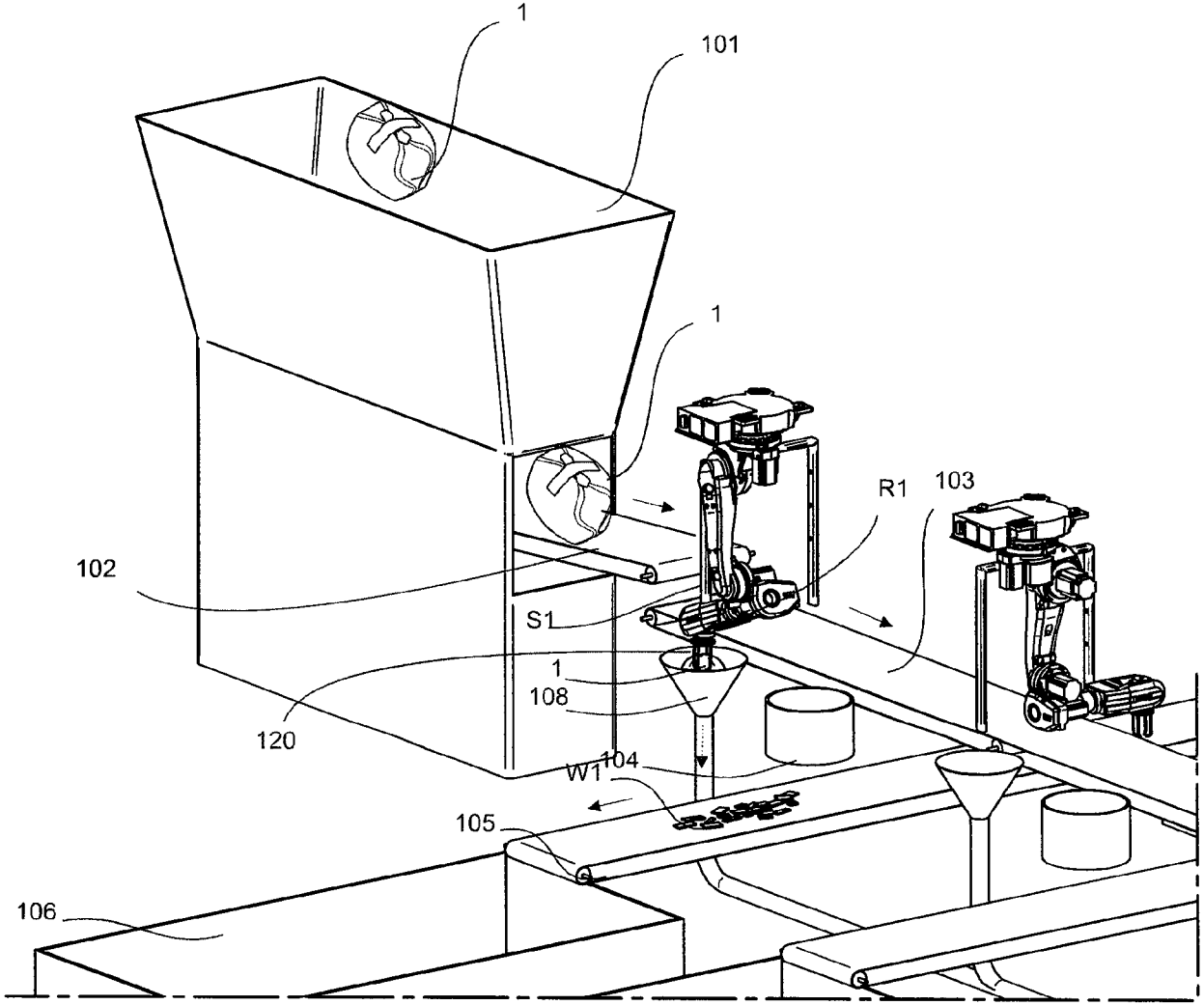
FIG. 4 presents a detail of a system according to the invention.

FIGS. 3 and 4 present a detail of the apparatus of FIG. 2. In FIG. 3, the first handling device R1 has taken a waste bag 1 from the main conveyor 103 and lifted it at first upwards, in which case the material on the conveyor in the proximity of the bag remains on the conveyor 103 or drops back onto the conveyor 103. After this the handling device R1 has transferred the waste bag to the ripping apparatus 104, in which case at least one hole forms in the bag, typically in the bottom part of it, from where the contents of the bag are able to drop by gravity onto the first sorting conveyor 105. The sorting conveyor transfers the waste allotment W1, which has been transferred from a bag onto the conveyor, into a container 106 or 107 or to further processing. In the embodiment of FIG. 4, the handling device transfers the empty waste bag 1 into a feeder hopper 108, from where a pipe conveyor transfers the bag in a transfer pipe 117 into a container 118.

When the first sensor S1 detects the first waste allotment to be separated from the main conveyor on the basis of the RFID identifier 3 on the bag of the waste bag 1, the information is relayed from the sensor S1 to the control system of the handling device R1. In this case the first handling device R1, which in the embodiment of the figure is a robot, grips the selected waste bag 1 that is on the conveyor belt of the main conveyor 103, lifts the bag upwards and then transfers the selected bag to the side.

The quantity of handling devices R1 . . . R5, robots in the embodiment of the figure, needed in sorting must be defined according to the waste quantities of the waste allotments to be sorted. In this case, e.g. paper and biowaste can be large waste allotments in terms of their waste quantity, and metal or glass correspondingly smaller waste allotments in terms of their waste quantity.

A number of handling means R1 . . . R5 can be used in sorting waste allotments that are large in terms of their waste quantity. There can be more handling means, e.g. robots, than is presented in the figure, e.g. two on different sides of the main conveyor 103. These handling means can drop the waste of a waste bag onto the same sorting conveyor 105 from a hole cut into the bag with a ripper 104.

Depending on the number of waste allotments to be sorted and on the amount of waste of each waste allotment, waste bags provided with RFID identifiers can be flexibly sorted with the apparatus according to the invention.

In the sorting apparatus, or in the proximity of it, are sensors S1, S2, S3, S4, S5 that read the information, or at least a part of the information, of the RFID identifier 3 of the closing means 2 of each waste bag 1 brought on the conveyor 103. The sensor S1, S2, S3, S4, S5 is preferably of a type that is able to read the information in the memory of an RFID identifier 3 remotely from a sufficiently long distance. The information is transmitted from the sensors S1, S2, S3, S4, S5 of the sorting apparatus e.g. to the control system of the system, on the basis of which information the handling elements R1 . . . R5 and/or the conveyors 102, 103, 105, 109, 110, 111, 112 are controlled.

Information from the sensors S1, S2, S3, S4, S5 can be transmitted to the control system wirelessly or by wireline, using data transfer methods and data transfer systems that are in themselves prior art.

The connection can also be bidirectional, in which case information coming from the sensors S1, S2, S3, S4, S5 can be saved in the memory of an RFID identifier 3. In this case the sensor S1, S2, S3, S4, S5 is not just a reading device but instead is a reading/transmission device of information.

An RFID identifier can be used to register the amount of waste produced by a certain user, in which case invoicing principles can be changed. On the other hand, a waste producer can be rewarded for sorting waste, e.g. by reducing the waste transport fees of waste that is fit for recycling.

According to a typical embodiment, the closing means is a closing sticker tape, which is an RFID sticker tape of the color of the waste allotment, which sticker tape comprises e.g. a text identifier according to the type of waste. In addition, an identification number or other identifier, which is separately specified according to each household, housing company, company or other waste producer that produces waste, can be formed for a closing means and/or RFID identifier.

The invention can thus be utilized by using the ordinary plastic carrier bags of a shop, which are closed with a closing means 2 according to the invention. The carrier bag is filled with waste and closed by knotting its carrying loops. A typical way is to tie at first one knot, after which a closing means, preferably a sticker tape, is placed on top of the knot, and fixed over the knot of the carrier bag. After that a second knot is made with the carrying loops. The RFID identifier in this case remains at least partly protected and avoids transport damage. The closing means according to the invention also prevents the opening of the knots of the waste bag.

In the waste sorting center to which the waste bags are transported with conventional garbage trucks or in some other way, the waste bags are sorted into different waste allotments on the basis of the information given by the RFID identifiers 3. After this the waste bags 1 are ripped open and the bags are removed from the rest of the waste. The RFID identifier of the closing means according to the invention can still be used to verify by the aid of a reader means that the waste bags have been removed from the sorted waste allotment.

The invention can be applied according to one preferred embodiment so that dedicated closing means, which comprise RFID identifiers, are supplied to each household. This assists sorting. In addition, by means of the combination of a closing means and RFID identifier according to the invention, it is easy to demonstrate where the costs of the waste handling system are generated. Fees can thus be allocated to waste producers more accurately than earlier.

According to one preferred embodiment, households have a fixed waste charge and receive a credit for each waste bag sorted in a sorting center. Based on the automatic reading of RFID identifiers, the system can allocate the sorted waste by means of an information system so that the credit goes to the correct target.

Although a combination of a closing means and an RFID identifier is the most preferred embodiment, the system does not exclude an alternative wherein waste bags comprising a ready RFID identifier are, if desired, used instead of a closing means. This, however, requires separate waste bags provided with an RFID identifier, for each waste allotment.

Sorting on the basis of an RFID identifier in a sorting center is very easy, as also is identification of a household. An RFID identifier gives numerous opportunities in waste sorting.

The invention thus relates to a method for sorting wastes, in which method the waste or recyclable material intended for sorting is brought in carrier bags, bags or sacks 1 to the sorting apparatus, which comprises a conveyor, from which the carrier bags, bags or sacks belonging to different waste allotments are separated from each other by guiding them into the containers according to the allotments or to further processing. An RFID identifier 3 is used in connection with the carrier bag, bag, sack 1 or corresponding used in waste transport, preferably a closing means 2 that is provided with an RFID identifier 3 is used in closing, or as verification of closing, the carrier bag, bag, sack 1 or corresponding, and in which method the carrier bags, bags, sacks 1, or corresponding, intended for sorting are moved on the conveyor, in connection with, or in the proximity of, at least one sensor S1, S2, S3, S4, S5 is arranged, on the basis of the information read from the RFID identifier 3 of which sensor at least one handling device R1, R2, R3, R4, R5, such as a robot, or a part of it, is controlled such that at least one handling device, or a part of it, transfers the carrier bags, bags, sacks 1, or corresponding, to be sorted from the conveyor into the different allotments on the basis of the information given by the RFID identifiers 3.

According to one preferred embodiment a carrier bag, bag, sack 1, or corresponding, is lifted from the conveyor at first upwards with at least one handling device R1 . . . R5 and is then transferred to further processing.

According to one preferred embodiment, in the method a carrier bag, bag or sack 1, such as a plastic carrier bag, plastic sack or plastic bag, that is freely chosen by the user is used in waste transport.

According to one preferred embodiment a handling device R1 . . . R5 transfers a carrier bag, bag, sack 1, or corresponding, from the conveyor into a means, such as a bag ripper 104, which brings about a hole in the carrier bag, bag, sack 1, or corresponding, from which hole the waste material or recyclable material inside is removed from the carrier bag, bag, sack 1, or corresponding.

According to one preferred embodiment, in the method a carrier bag, bag, sack 1, or corresponding, and the waste material or recyclable material are separated from each other.

According to one preferred embodiment in the method wastes are transferred from a hole formed in a bag, carrier bag, sack 1, or corresponding, onto a sorting conveyor, into a container or to further processing by means of gravity.

According to one preferred embodiment an emptied carrier bag, bag, sack 1, or corresponding, is transferred with a handling device into a container or into a feed-in container of the conveyor apparatus or to further processing.

According to one preferred embodiment in the method the carrier bags, bags, sacks 1, or corresponding, are transferred by a number of handling devices from the conveyor into different allotments in a sorted manner.

According to one preferred embodiment the carrier bags, bags, sacks 1, or corresponding, to be sorted are moved on the conveyor from the first end of the conveyor towards the second end, on the basis of the RFID identifiers 3 of the carrier bags, bags, sacks 1, or corresponding, to be transferred alongside the route of which conveyor the carrier bags, bags, sacks 1, or corresponding, are transferred with the handling devices into different allotments.

According to one preferred embodiment in the method a number of sensors S1, S2, S3, S4, S5 are arranged in connection with, or in the proximity of, the conveyor, on the basis of the information read from the RFID identifier 3 of which sensors a number of handling devices R1, R2, R3, R4, R5, such as robots, or a part of them, are controlled, such that the handling devices, or at least a part of them, transfer the carrier bags, bags sacks 1, or corresponding, to be sorted from the conveyor into the different allotments on the basis of the information given by the RFID identifiers 3.

According to one preferred embodiment at least a part of the wastes are led on the conveyor 103 directly to further processing or into a container.

According to one preferred embodiment, the carrier bags, bags and sacks 1, or corresponding, that have been separated from the wastes are transferred with a pneumatic pipe conveyor into a container or to further processing.

The invention also relates to an apparatus for sorting wastes, to which the waste or recyclable material intended for sorting is brought in carrier bags, bags or sacks 1, which apparatus comprises a conveyor 103, from which the carrier bags, bags or sacks belonging to different waste allotments are separated from each other by guiding them into the containers according to the allotments or to further processing. An RFID identifier 3 is arranged in connection with the carrier bag, bag, sack 1, or corresponding, preferably in a closing means 2 to be used in closing, or as verification of closing, the carrier bag, bag, sack 1, or corresponding, and that the conveyor is fitted to move the carrier bags, bags, sacks 1, or corresponding, intended for sorting, and that at least one sensor S1, S2, S3, S4, S5 is arranged in connection with, or in the proximity of, the conveyor, which sensor is fitted to read the information of an RFID identifier 3, and at least one handling device R1, R2, R3, R4, R5, such as a robot, and that at least one handling device, or a part of it, is fitted to transfer the carrier bags, bags, sacks 1, or corresponding, to be sorted from the conveyor 103 into the different allotments on the basis of the information given by the RFID identifiers 3.

According to one preferred embodiment the apparatus comprises means 104 for forming a hole in a carrier bag, bag, sack 1, or corresponding, from which hole the waste material or recyclable material inside is fitted to escape.

According to one preferred embodiment, the apparatus is fitted to use in waste transport a carrier bag, bag or sack 1, such as a plastic carrier bag, plastic sack or plastic bag, that is freely chosen by the user.

According to one preferred embodiment the apparatus is fitted to sort wastes into different allotments on the basis of the information given by the closing means 2 and/or the RFID identifiers 3.

According to one preferred embodiment the apparatus comprises sorting conveyors 105, 109, 110, 111, 112 that are transverse with respect to the conveyor 103, which sorting conveyors are fitted to receive a sorted waste allotment.

According to one preferred embodiment the apparatus comprises containers 106, 107 for the sorted waste allotments.

According to one preferred embodiment the handling device R1 . . . R5 comprises gripping means 120 for gripping a carrier bag, bag, sack 1, or corresponding, to be sorted.

According to one preferred embodiment a number of sensors S1, S2, S3, S4, S5 are arranged in connection with, or in the proximity of, the conveyor 103, which sensors are fitted to read an RFID identifier 3 and means to control a number of handling devices R1, R2, R3, R4, R5, such as robots, or parts of them, such that the handling devices, or at least a part of them, transfer the carrier bags, bags, sacks 1, or corresponding, to be sorted from the conveyor 103 into the different allotments on the basis of the information given by the RFID identifiers 3.

According to one preferred embodiment the apparatus comprises means for transferring the carrier bags, bags or sacks 1, or corresponding, separated from the wastes into a container or to further processing.

The use of an RFID identifier in connection with a pneumatic waste transport system is described in publication WO 2005/118435. The use of an RFID identifier in the sorting of waste is presented in publication WO 2006/096101.

It is obvious to the person skilled in the art that the invention is not limited to the embodiments presented above, but that it can be varied within the scope of the claims presented below. The characteristic features possibly presented in the description in conjunction with other characteristic features can also, if necessary, be used separately to each other.

The invention claimed is:

1. A method of using a waste sorting system for sorting individual carrier bags, each of which contains only one of multiple waste materials or only one of multiple recyclable materials, the waste sorting system comprising:

closing means used for closing or verification of closing of each of the individual carrier bags, a waste type of the one of multiple waste materials or the one of multiple recyclable materials being visually marked on the closing means of each of the individual carrier bags, an RFID identifier arranged in the closing means of each of the individual carrier bags for identifying the one waste material or the one recyclable material in each of the individual carrier bags, a conveyor capable of conveying each of the individual carrier bags, multiple handling devices (R1, R2, R3, R4, R5) arranged one after another along a length of the conveyor, each of the handling devices including:

multiple sensor devices (S1, S2, S3, S4, S5) capable of reading the RFID identifier of each of the individual carrier bags, and multiple containers arranged adjacently to each of the handling devices (R1, R2, R3, R4, R5), the method comprising the following steps:

supplying only one of the multiple waste materials or the one recyclable material in each of the individual carrier bags;

arranging each of the individual carrier bags one after the other on the conveyor while the conveyor is moving;

moving each of the individual carrier bags via the conveyor until the one of the sensor devices (S1, S2, S3, S4, S5) is able to read at least part of the RFID identifier on one of the individual carrier bags arranged alongside a route of the conveyor, and then;

depositing the one waste material or the one recyclable material from each of the individual carrier bags into an appropriate one of the multiple containers based on the RFID identifier read by the sensor device associated with the appropriate one of the multiple containers, and holding the waste material or the one recyclable material from each of the carrier bags in the containers for further processing.

2. The method according to claim 1, further comprising:

freely choosing the carrier bags to be used in waste transport.

3. The method according to claim 1, further comprising:

causing the handling devices (R1, R2, R3, R4, R5) to transfer each of the carrier bags from the conveyor into a bag ripper, forming a hole in each of the carrier bags by means of the bag ripper, and enabling the one waste material or the one recyclable material inside each of the carrier bags to be removed.

4. The method according to claim 1, the method further comprising:

placing a first one of the waste materials or a first one of the recyclable materials in a first one of the carrier bags, and respectively placing another of the waste materials or another of the recyclable materials in second and third carrier bags which are separate from the first one of the carrier bags.

5. The method according to claim 1, the method further comprising:

forming a hole in each of the carrier bags;

transferring the one waste material or the one recyclable material in each of the carrier bags from the hole formed in each of the carrier bags into the appropriate one of the multiple containers by means of gravity.

6. The method according to claim 5, the waste sorting system comprising:

a feed hopper associated with the each of the handling devices (R1, R2, R3, R4, R5), the method further comprising:

after each of the carrier bags has been emptied of the one waste material or the one recyclable material in each of the carrier bags, transferring each of the empty carrier bags into the feed hopper for further processing.

7. The method according to claim 1, the method further comprising:

sorting each of the multiple waste materials and the multiple recyclable materials by using a different one of the multiple handling devices (R1, R2, R3, R4, R5).

8. The method according to claim 1, the multiple containers further comprising:

a first one of the containers and a second one of the containers arranged respectively on opposite sides of each of the multiple handling devices (R1, R2, R3, R4, R5), the method further comprising:

depositing the first one of the waste materials or the first one of the recyclable materials contained in the first container, and depositing the second one of the waste materials or the second one of the recyclable materials contained in the second container.

9. The method according to claim 8, the method further comprising:

moving each of carrier bags via the conveyor from a first end of the conveyor towards a second end of the conveyor, by an amount limited to a distance between the first end of the conveyor and a point that the RFID identifier of each of the carrier bags is read by the specific one of the sensor devices (S1, S2, S3, S4, S5).

10. The method according to claim 8, the method further comprising:

placing the first one waste material or the first one recyclable material in a first one of the carrier bags, respectively placing the second one of the waste materials or the second one of the recyclable materials in second and third carrier bags which are separate from the first one of the carrier bags, and depositing the first one of the waste materials or the first one of the recyclable materials contained in the first carrier bag with one of the RFID identifiers identified by one of the first one of the containers corresponding to one of the multiple handling devices (R1, R2, R3, R4, R5), and separately depositing the second one of the waste materials or the second one of the recyclable materials contained in the second carrier bag with another one of the RFID identifiers into the second one of the containers corresponding to another of the multiple handling device devices (R1, R2, R3, R4, R5).

11. The method according to claim 1, wherein each of handling devices (R1, R2, R3, R4, R5) is a robot.

12. The method according to claim 1, the waste sorting system comprising:

multiple feed hoppers being equal in number to the number of the multiple handling devices (R1, R2, R3, R4, R5), so that a different one of the multiple feed hoppers is associated with each of the multiple handling devices (R1, R2, R3, R4, R5), the method further comprising:

transferring the one waste material or the one recyclable material from each of the carrier bags into each of the multiple feed hoppers, after each of the carrier bags has been emptied of the one waste material or the one recyclable material.

13. A waste sorting system for sorting individual carrier bags each of which contains only one of multiple waste materials or only one of multiple recyclable materials, comprising:

closing means for closing or verification of closing of each of the individual carrier bags, a waste type of the one of multiple waste materials or the one of multiple recyclable materials being visually marked on the closing means of each of the individual carrier bags, an RFID identifier arranged in the closing means of each of the individual carrier bags for identifying the one waste material or the one recyclable material in each of the individual carrier bags, a conveyor capable of conveying each of the individual carrier bags one after another, multiple handling devices (R1, R2, R3, R4, R5) arranged one after another along a length of the conveyor, each of the multiple handling devices (R1, R2, R3, R4, R5) including:

multiple sensor devices (S1, S2, S3, S4, S5) capable of reading the RFID identifier of each of the individual carrier bags while the carrier bags are being conveyed on the conveyor, and multiple containers arranged adjacently to each of the multiple handling devices (R1, R2, R3, R4, R5), and wherein the conveyor is adapted to convey each the individual carrier bags along the conveyor until a specific one of the sensor devices (S1, S2, S3, S4, S5) is able to read at least part of the RFID identifier on one of the individual carrier bags arranged alongside a route of the conveyor, upon which, one of the handling devices (R1, R2, R3, R4, R5) is capable of depositing the one waste material or the one recyclable material into an appropriate one of the multiple containers based on the RFID identifier read by the specific one of the sensor devices (S1, S2, S3, S4, S5) associated with the appropriate one of the multiple containers, and after the one waste material or the one recyclable material from each of the carrier bags has been deposited into the appropriate one of the multiple containers, the one waste material or the one recyclable material is held in the appropriate one of the multiple containers for further processing.

14. The waste sorting system method according to claim 13, wherein the system comprises:

a bag ripper for forming a hole in each of the carrier bags for enabling the one waste material or the one recyclable material inside in each of the carrier bags to escape.

15. The waste sorting system according to claim 13, wherein each of the carrier bags is freely chosen by a user of the system.

16. The waste sorting system according to claim 13, wherein the system is adapted to sort the one waste material or the one recyclable material in each of the carrier bags into different allotments based on information given by the closing means and/or the RFID identifiers.

17. The waste sorting system according to claim 13, wherein the system comprises:

multiple sorting conveyors that are transverse with respect to the conveyor, each of the sorting conveyors are being adapted to receive the one waste material or the one recyclable material contained in each of the carrier bags based on the RFID identified on each of the carrier bags.

18. The waste sorting system according to claim 13, wherein the multiple containers further comprise:

a first one of the containers and a second one of the containers arranged respectively on opposite sides of each of the handling devices (R1, R2, R3, R4, R5), wherein the system is adapted to:

deposit the first one of the waste materials or the first one of the recyclable materials contained in the first container, and deposit the second one of the waste materials or the second one of the recyclable materials contained in the second container.

19. The waste sorting system according to claim 18, wherein the system is adapted to move each of the carrier bags via the conveyor from a first end of the conveyor towards a second end of the conveyor, by an amount limited to a distance between the first end of the conveyor and a point that the RFID identifier of each of the carrier bags is read by the specific one of the sensor devices (S1, S2, S3, S4, S5).

20. The waste sorting system according to claim 18, wherein the system is adapted to place the first one of the waste materials or the first one of the recyclable materials in the first one of the carrier bags, to respectively place the second one of the waste materials and or the second one of recyclable materials in second and third carrier bags which are separate from the first one of the carrier bags, to deposit the first one of the waste materials or the first one of the recyclable materials contained in the carrier bag with a first one of the RFID identifiers into a first one of the containers corresponding to one the multiple handling devices (R1, R2, R3, R4, R5), and to separately deposit the second one of the waste materials or the second one of the recyclable materials contained in the second carrier bag with a second one of the RFID identifiers into the second one of the containers corresponding to another of the multiple handling devices (R1, R2, R3, R4, R5).

21. The waste sorting system according to claim 13, wherein each of the handling devices (R1, R2, R3, R4, R5) further comprises:

gripping means for gripping the carrier bags.

22. The waste sorting system according to claim 13, wherein each of the handling devices (R1, R2, R3, R4, R5) is a robot.

23. The waste sorting system according to claim 13, wherein the system further comprises:

feed hoppers for transferring the carrier bags after each of the carrier bags has been emptied of the one waste material or the one recyclable material.

24. A waste sorting system for sorting individual carrier bags each of which contains only one of multiple waste materials or only one of multiple recyclable materials, comprising:

closing means for closing or verification of closing of each of the individual carrier bags, an RFID identifier arranged in the closing means of each of the individual carrier bags for identifying the one waste material or the one recyclable material in each of the individual carrier bags, a conveyor capable of conveying each of the individual carrier bags one after another, multiple handling devices (R1, R2, R3, R4, R5) arranged one after another along a length of the conveyor, each of the multiple handling devices (R1, R2, R3, R4, R5) including:

multiple sensor devices (S1, S2, S3, S4, S5) capable of reading the RFID identifier of each of the individual carrier bags, while the carrier bags are being conveyed on the conveyor, and multiple containers arranged adjacently to each of the multiple handling devices (R1, R2, R3, R4, R5), wherein the multiple containers further comprise:

a first one of the containers and a second one of the containers arranged respectively on opposite sides of each of the multiple handling devices (R1, R2, R3, R4, R5), and wherein the system is adapted to:

deposit the first one of the waste materials or the first one of the recyclable materials contained in the first container, and deposit the second one of the waste materials or the second one of the recyclable materials contained in the second container, wherein the conveyor is adapted to convey each the individual carrier bags along the conveyor until a specific one of the sensor devices (S1, S2, S3, S4, S5) reads a specific one of the RFID identifiers on each of the individual carrier bags being conveyed, upon which, one of the handling devices (R1, R2, R3, R4, R5) is capable of depositing the one waste material or the one recyclable material into an appropriate one of the multiple containers based on the RFID identifier read by the specific one of the sensor devices (S1, S2, S3, S4 S5) associated with the appropriate one of the multiple containers, and after the one waste material or the one recyclable material from each of the carrier bags has been deposited into the appropriate one of the multiple containers, the one waste material or the one recyclable material is held in the appropriate one of the multiple containers for further processing.

* * * * *